United States Patent [19]

Merila

[11] 4,174,787

[45] Nov. 20, 1979

[54] SODA STRAW DISPENSER

[76] Inventor: John B. Merila, 6223 E. 127th St., Grandview, Mo. 64030

[21] Appl. No.: 913,485

[22] Filed: Jun. 7, 1978

[51] Int. Cl.[2] ..... B65H 3/56

[52] U.S. Cl. ..... 221/254

[58] Field of Search ..... 221/254, 203, 188

[56] References Cited

U.S. PATENT DOCUMENTS 897,642 9/1908 Murray ..... 221/254 X

*Primary Examiner*—Stanley H. Tollberg

*Attorney, Agent, or Firm*—John A. Hamilton

[57] ABSTRACT

A soda straw dispenser consisting of a horizontal fixed drum adapted to contain soda straws resting longitudinally therein, and having a longitudinal discharge slot in an upper portion thereof, and a rotor carried in the drum and including a straw carrier operable on a partial rotation of the rotor to select a single straw from those in the container, elevate it to the discharge slot, and eject it through the slot to a station at which it may be manually grasped for removal. Special provisions are made to prevent escape of the straw from the carrier by any avenue other than through the slot, for example back into the drum.

7 Claims, 12 Drawing Figures

SODA STRAW DISPENSER

This invention relates to new and useful improvements in soda straw dispensers of the type commonly used, for example, at soda fountains, lunch counters, fast-food establishments and the like. The principal object of this invention is the provision of a dispenser operable, for example, by depression of an operating bar, to pick up a single straw from a large number of straws disposed in a sanitary container and deliver said single straw to a point external to the container where it may be grasped and removed. Thus only the person who will make eventual use thereof need touch the straw.

Generally, this object is accomplished by the provision of a container comprising a hollow horizontal drum adapted to support a large number of straws longitudinally therein, and having a longitudinal discharge slot formed in an upper portion thereof, and a rotor disposed coaxially in said drum for rotation therein. The rotor includes a straw carrier operable as the rotor is turned to select a single straw from the drum, elevate it to the level of the discharge slot and eject it through said slot to a holder external to the drum, where it may be grasped and removed for use.

The straw carrier must of course be in free communication with the drum, and there is hence the possibility that a straw, once received in the carrier, might exit therefrom back into the drum, rather than outwardly through the discharge slot. The prevention of this occurrence is another object of this invention. Generally, it is accomplished by rendering the carrier capable of supporting the straw in two positions, a first position in which it is received directly from the drum, and a second position, trailing the first, to which the straw falls by gravity as it approaches the discharge slot, thereby delaying the arrival of the straw at the discharge slot and requiring additional movement of the rotor to bring the straw to the discharge slot. During this additional rotor movement, cooperating members carried by the rotor and drum close all possible avenues of escape of the straw from the carrier except through the discharge slot.

A further object is the provision of means operable to agitate or jostle the mass of straws carried in the drum before and after each straw is dispensed, in order to rearrange and properly align the straws in the event they have become disarranged.

Other objects are simplicity and economy of structure, and efficiency and dependability of operation.

Figure 1:
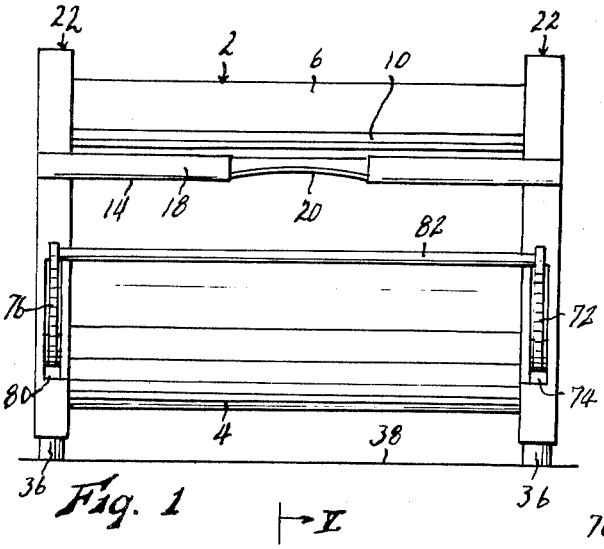
Figure 2:
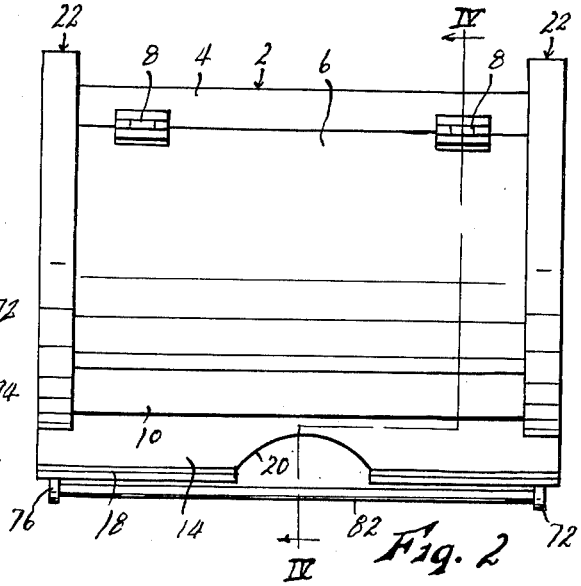
Figure 3:
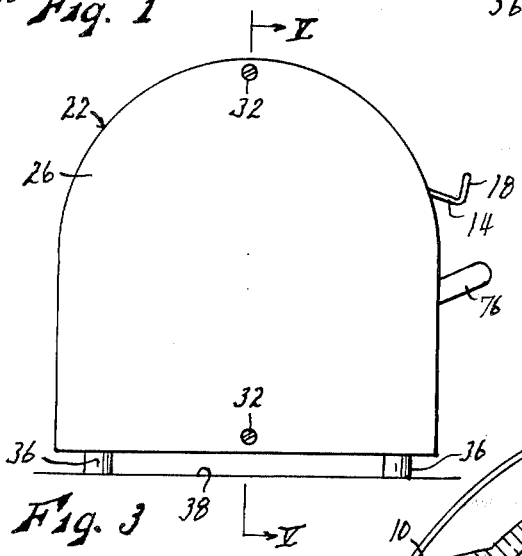
Figure 4:
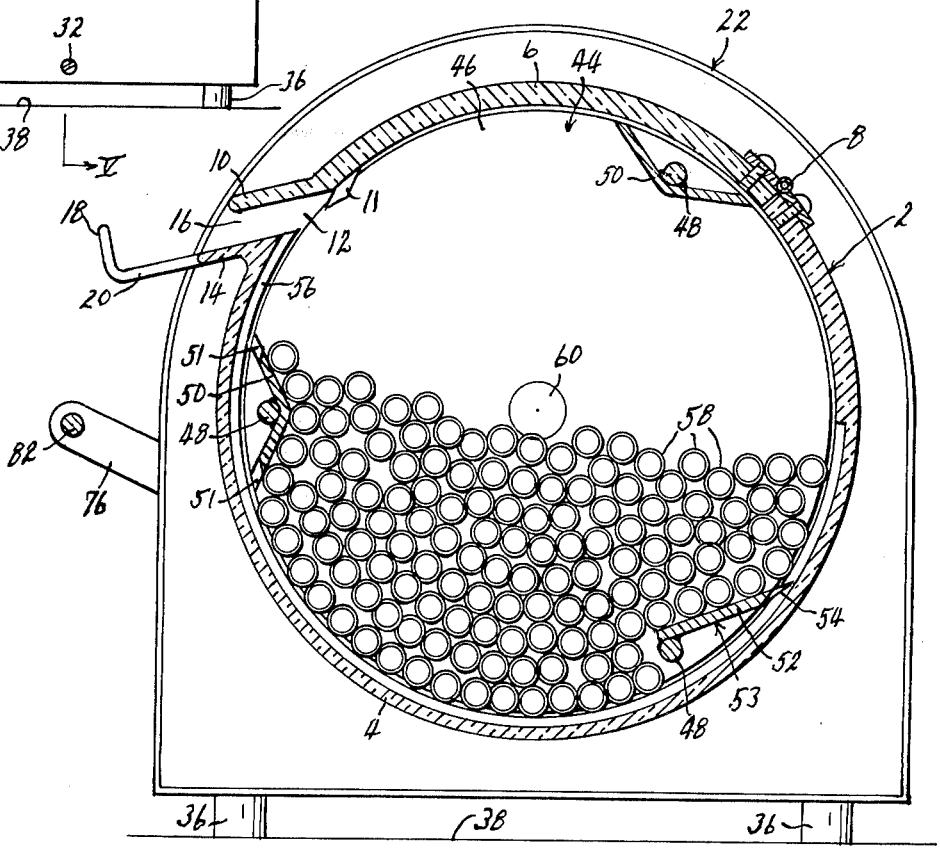
Figure 5:
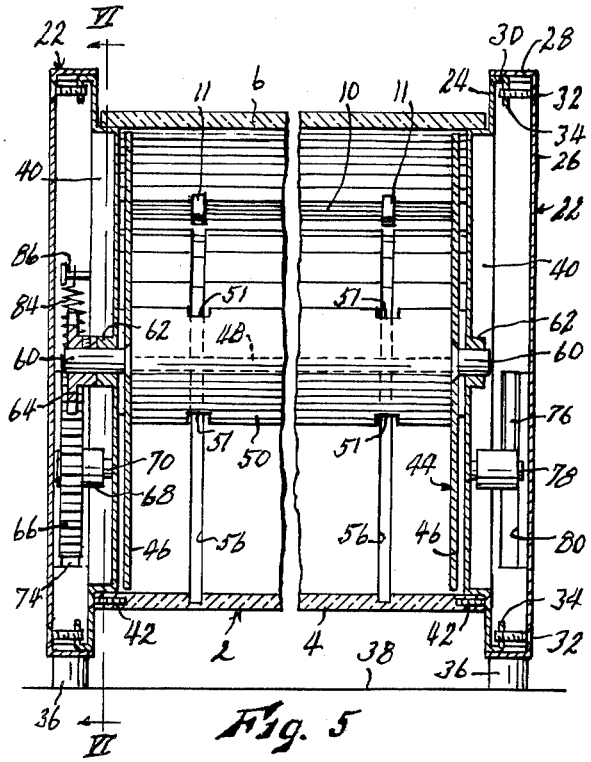
Figure 6:
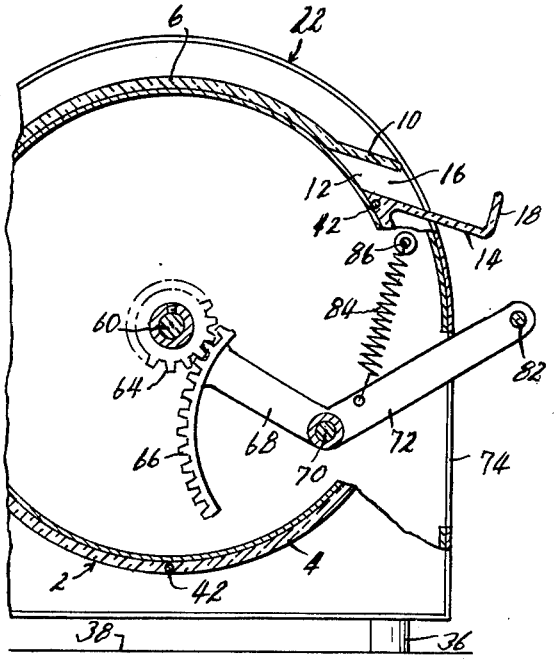

With these objects in view, as well as other objects which will appear in the course of the specification, reference will be had to the accompanying drawing showing a preferred embodiment of the invention, wherein:

FIG. 1 is a front elevational view of a soda straw dispenser embodying the present invention, FIG. 2 is a top plan view thereof, FIG. 3 is a left end view thereof, FIG. 4 is an enlarged sectional view taken on line IV—IV of FIG. 2, FIG. 5 is an enlarged, foreshortened sectional view taken on line V—V of FIG. 3, with the straws omitted, FIG. 6 is a fragmentary sectional view taken on line VI—VI of FIG. 5, partially broken away, and FIGS. 7–12 are fragmentary views similar to FIG. 4, and showing successive stages in the dispensing of a single straw.

Like reference numerals apply to similar parts throughout the several views, and the numeral 2 applies generally to a cylindrical drum formed of any suitable material, preferably transparent so that the straws to be carried therein may be viewed and the operation of the device rendered a matter of conversational interest. Said drum consists of a greater-than-semicircular lower body portion 4, open at its top, and a cover portion 6 nearly completing the cylindrical shape of the body portion, and hinged at its rearward edge to said body portion, as at 8, whereby when it is opened soda straws may be deposited in the drum. At its forward edge, cover 6 is provided with an outwardly and downwardly inclined planar lip 10. At the juncture of cover 6 and lip 10, in spaced relation along the length of said juncture, there are affixed a pair of short downwardly and forwardly inclined lugs 11, which may be integral with or affixed to the cover, and which are inclined more steeply than lip 10. Below lip 10, the forward edge of body portion 4, which is spaced apart below the forward edge of the cover to provide a discharge slot 12 therebetween, said slot extending longitudinally of the drum in the upper forward portion thereof, is also provided with a forwardly and downwardly inclined planar lip 14, disposed in spaced apart parallel relation below lip 10 to form an exit chute 16 therebetween. Lip 14 extends forwardly of the forward edge of lip 10, and its forward edge portion is turned upwardly to form a stop 18. The central portion of lip 14 and stop 18 are notched out as indicated at 20. Lugs 11 partially block the entry to discharge slot 12.

Each of the ends of drum body portion 4 is affixed to an end wall indicated generally by the numeral 22. As best shown in FIG. 5, each of end walls 22 is hollow, being formed of a vertical inner plate 24 and a parallel outer plate 26, said outer plate being provided with a peripheral flange 28 which is engaged telescopingly over a corresponding peripheral flange 30 of the inner plate, said plates being releasably secured in assembly by a pair of screws 32 based in the outer plate and tabs 34 struck out from flange 30 of the inner plate. Said end walls are straight and horizontal at their lower edges, and each is provided at said lower edge thereof with a pair of rubber feet 36 whereby the dispenser is supported on a table or counter top 38 or any other planar supporting surface, supporting drum 2 in spaced apart relation above said supporting surface.

Still referring to FIG. 5, the inner plate 24 of each end wall 22 has a circular dish-shaped offset 40 formed therein concentrically with drum 2, and extending snugly into the adjacent end portion of drum 2. The extreme ends of body portion 4 of the drum are secured to plates 24 by screws 42 (see FIGS. 5 and 6). Cover 6 is slightly narrower than body portion 4, and pivots freely between plates 24.

Disposed for coaxial rotation in drum 2 is a rotor designated generally by the numeral 44, comprising a pair of circular end plates 46 of a diameter to fit rotatably in the drum, and disposed respectively adjacent the end walls 22 thereof, and three spacer rods 48 extending between said end plates and rigidly affixed thereto in parallel relation to the rotor axis. The orbit of said spacer rods, as the rotor turns, is spaced slightly rearwardly from lugs 11, so as to be capable of passing thereby. Said spacer rods are equidistant from the rotor axis, joining the edge portions of the rotor end plates, and are regularly spaced angularly about the rotor axis. Two of said spacer rods each have an agitator member 50 affixed thereto. Said agitator member is elongated to extend the full distance between end plates 46, and is of broad V-shaped cross-sectional contour with the apex facing toward the rotor axis, and with its side edges flush with the periphery of the end plates so as to move freely in the drum. One of said agitators, which must pass lugs 11 as the rotor turns is notched as at 51 to permit this passing. The third of spacer rods 48 has affixed thereto a plate 52 similar to one half of agitators 50, consisting of a planar plate affixed along one edge to its spacer rod 48, and angularly inclined outwardly therefrom to be flush with the peripheries of end plates 46. Plate 52, together with its rod 48, form a straw carrier designated generally by the numeral 53. Keeping in mind, as will presently appear, that FIG. 4 shows the rotor in its normal or rest position, and that said rotor is turned 180 degrees in a clockwise direction from that shown to dispense a straw, plate 52 is inclined outwardly from its rod 48 in a counter-clockwise direction, and its outer edge is offset angularly from the lower edge of discharge slot 12 by 180 degrees. Also, plate 52 is provided at two spaced apart points along its outer edge with generally coplanar extensions each forming a tapered finger 54, which may be aligned with lugs 11. Each of said fingers projects into a matching internal groove 56 formed in drum body member 4. Said grooves extend to the lower edge of discharge slot 12, and are of sufficient angular extent to permit the described 180 degree turning of the rotor, as shown in FIG. 4. The drum is adapted to receive a large number of soda straws 58 therein, the straws resting in the lower portion of the drum in parallel relation to its axis, as indicated in FIG. 4, cover 6 being opened to permit their insertion. The distance between rotor end plates 46 may be selected to accomodate straws of any desired length therebetween. Each end plate 46 of the rotor has a coaxial stub axle 60 affixed therein and projecting outwardly therefrom, each stub axle being rotatably journalled in a bearing 62 mounted in the inner plate 24 of the associated end wall 22, whereby the rotor is supported for rotation.

One of said stub axles, the right as shown, projects into the hollow interior of its associated end wall 22, and has a gear pinion 64 fixed thereon within said end wall. Meshing with said gear is a gear segment 66 carried by an arm 68 pivoted on a stub axle 70 parallel to the rotor axis, and fixed on inner plate 24 of the end wall. A lever 72, fixed relative to arm 68, projects forwardly through a vertically elongated slot 74 formed in the overlying flanges 28 and 30 of right side wall 22, at the forward edge thereof beneath lip 14, and extends forwardly thereof. A second lever 76 similar to lever 72 is carried by left side wall 22, being pivoted on a stub axle 78 coaxial with stub axle 70, and projecting forwardly through a vertical slot 80 of said left side wall. Levers 72 and 76 are parallel, and their forward ends are rigidly interconnected by a horizontal bar 82 extending transversely therebetween, said bar being disposed forwardly of drum 2, in spaced apart relation beneath the forward edge of drum lip 14. Levers 72 and 76 are biased resiliently upwardly to the upper ends of their slots 74 and 80 by a tension spring 84 disposed in right side wall 22, said spring being connected at its lower end to lever 72 and at its upper end to a pin 86 fixed to inner plate 24 of said end wall. Said spring normally biases rotor 44 to the position shown in FIG. 4, wherein straw carrier 53 is disposed well to the rear of the vertical midplane of drum 2, but is rotated in a clockwise direction, by pressing downwardly on bar 82, the length of slots 74 and 80 being such as to limit the rotation of drum 2 to 180 degrees, which is the position thereof shown in FIGS. 11 and 12.

Figure 7:
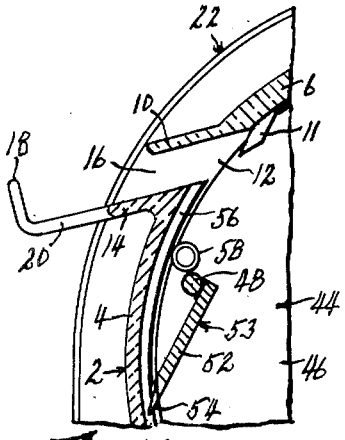

In the operation of the dispenser, it will be seen that as drum 2 is turned by pressing downwardly on bar 82 as just described, straw carrier 53 moves forwardly through the mass of straws 58 carried in the drum. During this movement, a single straw will be trapped between rod 48 of the carrier and the internal surface of the drum, as shown in FIG. 7, said rod being spaced from the internal drum surface by a distance less than the diameter of the straw, and therefore will be pushed along ahead of the carrier. As soon as the straw is thus moved through the horizontal midplane of the drum, or slightly thereabove, all other straws will fall away from the carrier, and the carrier will then be supporting only a single straw, as in FIG. 7. The drum should not be more than about half filled with straws, to prevent accidental discharge of straws through discharge slot 12 prior to this time.

Figure 8:
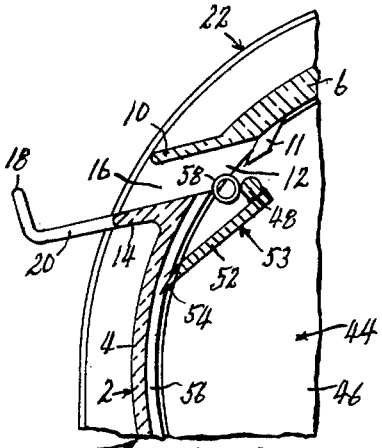
Figure 9:
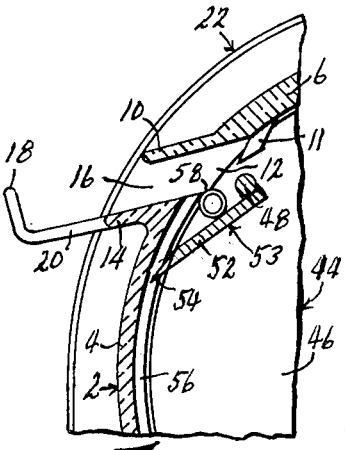

When the straw engaged in the carrier reaches the lower edge of discharge slot 12, and the carrier continues to move, the spacing between the lower lip of said slot and rod 48 of the carrier gradually increases, as indicated in FIG. 8, and when said space becomes wide enough, the straw will drop therethrough to rest between carrier plate 52 and the internal surface of the drum, as shown in FIG. 9. Continued rotation of the carrier of course causes the carrier to resume movement of the straw toward the discharge slot, with plate 52 then being the operating element of the carrier, but the arrival of the straw in a discharge position relative to the slot is thereby slightly delayed, and during this delay rotation of the carrier continues. If it were not for this delay, the carrier, which must of course by "open" to the drum to receive the straw therein as in FIG. 7, might simply "throw" the straw, its upward movement being continued by its own momentum after motion of the carrier is arrested by levers 72 and 76, and it might be deflected back into the interior of the drum rather than outwardly into discharge chute 16. With the described "straw delaying" action of the "two step" carrier, during which delay period the motion of the carrier continues, it will be seen that by the time carrier plate 52 again elevates the straw to the level of discharge slot 12, as shown in FIG. 10, carrier rod 48 will have passed beyond said slot, and since said rod is then spaced apart from cover 6 by a distance less than the diameter of a straw, the straw cannot pass therebetween to re-enter the drum, but must pass outwardly through slot 12 and discharge chute 16 to roll down lip 14 by gravity and rest against stop 18, whereupon the portion thereof exposed within notch 20 may be grasped for easy removal thereof.

Lugs 11 further assist in preventing the straw in the carrier from re-entering the drum, by further closing any gap between carrier plate 52 and cover 6. Actually, the discharging action would in most cases function satisfactorily without lugs 11, but without them there might exist the remote possibility, particularly when the rotor is turned with a very high speed, that a straw could be trapped and wedged or clamped between plate 52 and the cover, and thereby retained against outward movement through slot 12. Lugs 11 prevent this occurrence.

Figure 10:
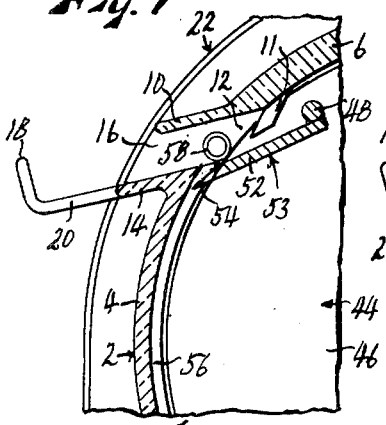
Figure 11:
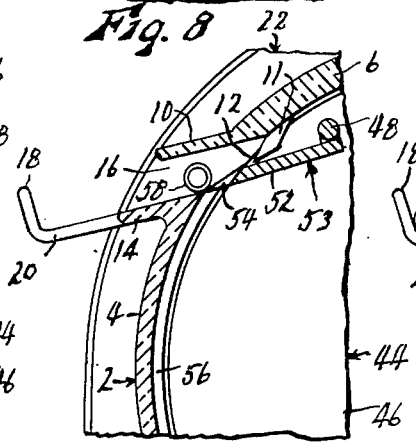
Figure 12:
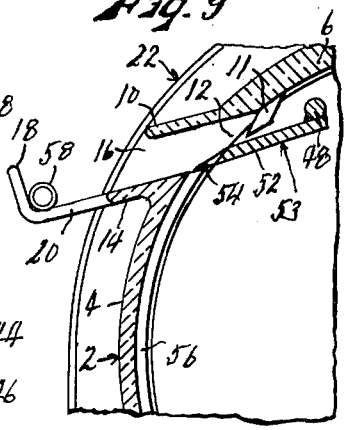

When the straw is elevated to the FIG. 10 position by carrier plate 52, there may exist a slight gap between the edge of the plate and the lower lip of the slot, said gap forming a depression in which the straw could rest by gravity and be retained. To prevent this the rotor is permitted a slight additional movement, moving the carrier to its final position as shown in FIGS. 11 and 12, before its movement is arrested by engagement of levers 72 and 76 with the lower ends of slots 74 and 80. During this slight additional movement, fingers 54 of carrier plate 52 rise slightly above the level of lip 14, thereby elevating the straw to lift it out of the aforementioned depression. The taper of fingers 54 provides a downwardly and forwardly inclined ramp, down which the straw will roll by gravity to engage and roll along lip 14 to rest against stop 18, as shown in FIG. 12. The rotor is returned to its normal FIG. 4 position by spring 84 whenever manual pressure on bar 82 is released. During rotation of the rotor in either direction, one or both of agitators 50 will pass through the pile of straws in the lower portion of the drum, agitating said straws to assist in causing them to return to their longitudinal alignment in the drum, in the event they have become disarranged.

While I have shown and described a specific embodiment of my invention, it will be readily apparent that many minor changes of structure and operation could be made without departing from the spirit of the invention.

What I claim as new and desire to protect by Letters Patent is:

1. A soda straw dispenser comprising:

a. a fixed, generally cylindrical hollow drum having its axis disposed horizontally and adapted to contain a large number of straws therein parallel to the axis thereof, each of said straws being of a given length and diameter, and having a downwardly and outwardly inclined chute communicating with the upper forward portion thereof through a longitudinal, horizontal discharge slot thereof, b. a rotor mounted coaxially in said drum and being axially rotatable therein, c. a straw carrier consisting of a rod fixed in said rotor and extending parallel to the axis thereof, said rod being spaced apart from the interior surface of said drum by a distance less than the diameter of a single straw, and d. manually operable drive means operable to turn said rotor from a rest position in which said carrier rod is disposed rearwardly of the vertical midplane of said drum, forwardly around the lower portion of said drum, during which movement a single straw is trapped between said rod and the interior wall surface of said drum, and further in the same direction to a discharge position in which said single straw is elevated to the level of said discharge slot and rolls outwardly by gravity through said chute.

2. A soda straw dispenser as recited in claim 1 with the addition of resilient means biasing said rotor in a direction opposite to that produced by said drive means, whereby said carrier rod is returned to said rest position whenever said drive means is released.

3. A soda straw dispenser as recited in claim 1 with the addition of means effectively closing any route by which the straw trapped by the carrier could return from said carrier to the straws remaining in the drum, before said straw is elevated to said discharge slot by said carrier.

4. A soda straw dispenser as recited in claim 1 wherein said straw carrier additionally includes an elongated plate extending parallel to the axis of said rotor, one longitudinal edge of said plate being affixed to said carrier rod at the side thereof remote from said interior drum wall surface, and extending transversely to said rod, in a trailing direction therefrom having reference to the direction of rotation of said rotor by said drive means, with its free longitudinal edge in closely spaced relation to said interior drum surface, whereby when said carrier rod passes the lower lip of said discharge slot, its spacing from said lip increases and said straw drops therebetween to rest between said carrier plate and said interior drum surface, said plate then functioning as a carrier to further elevate said straw to said discharge slot on further turning of said rotor, the transverse width of said carrier plate being sufficiently great that when the carrier plate has elevated said single straw to its discharge position, said carrier rod will have advanced beyond the upper lip of said discharge slot, whereby said carrier prevents passage of any straw between said discharge slot and said drum.

5. A soda straw dispenser as recited in claim 4 with the addition of a lug affixed to said drum at the upper lip of said discharge slot and extending downwardly into said slot and said drum, but not preventing passage of a straw from said carrier into said slot, said lug being disposed in closely spaced outward relation from the orbit of said carrier rod and extending into closely spaced relation to said carrier plate when the latter is in its discharge position.

6. A soda straw dispenser as recited in claim 4 wherein said carrier plate is provided with fingers projecting from its free longitudinal edge in spaced relation therealong, said fingers projecting to a radius from the rotor axis greater than the internal diameter of said drum, and each accomodated in an internal peripherally extending groove of said drum, said carrier plate in its discharge position rising slightly above the lower lip of said discharge slot, in parallel relation to the lower surface of said inclined discharge chute, whereupon said fingers form an inclined ramp for conveying said straw from said carrier plate to said discharge chute.

7. A soda straw dispenser as recited in claim 1 wherein said rotor additionally includes agitator members extending parallel to said straw carrier but in angularly offset relation therefrom, and spaced closely to the interior surface of said drum, whereby as said rotor is turned by said drive means, said agitator members pass through and jostle the mass of straws carried in the lower portion of the drum, whereby to assist in realigning any straws in proper relation to the drum which may have become disarranged relative thereto.

* * * * *